US009856642B2

(12) United States Patent
Ukrainetz

(10) Patent No.: US 9,856,642 B2
(45) Date of Patent: Jan. 2, 2018

(54) CORRUGATED FURRING STRIPS AND USE OF SAME IN UPRIGHT WALL STRUCTURES

(71) Applicant: Michael Wayne Ukrainetz, Whitehorse (CA)

(72) Inventor: Michael Wayne Ukrainetz, Whitehorse (CA)

( * ) Notice: Subject to any disclaimer, the term of this patent is extended or adjusted under 35 U.S.C. 154(b) by 0 days.

(21) Appl. No.: 15/272,049

(22) Filed: Sep. 21, 2016

(65) Prior Publication Data

US 2017/0096814 A1 Apr. 6, 2017

(30) Foreign Application Priority Data

Oct. 5, 2015 (CA) ..... 2907245

(51) Int. Cl.

| | |
|---|---|
| ***E04B 2/60*** | (2006.01) |
| ***E04B 2/56*** | (2006.01) |
| ***E04B 1/70*** | (2006.01) |
| ***E04C 3/00*** | (2006.01) |
| ***E04B 1/41*** | (2006.01) |

(52) U.S. Cl.

CPC ..... *E04B 2/60* (2013.01); *E04B 1/40* (2013.01); *E04B 1/7038* (2013.01); *E04B 1/7076* (2013.01); *E04B 2/56* (2013.01); *E04C 3/00* (2013.01)

(58) Field of Classification Search

CPC combination set(s) only.
See application file for complete search history.

(56) References Cited

U.S. PATENT DOCUMENTS 3,477,187 A * 11/1969 Fruman ..... E04F 13/0803 52/346
3,690,083 A * 9/1972 Miller ..... E04F 13/081 52/243.1
4,382,353 A * 5/1983 Kelly ..... E04D 1/365 52/309.5
6,279,284 B1 * 8/2001 Moras ..... E04B 1/10 52/105
6,945,001 B1 * 9/2005 Suzuki ..... E04B 7/22 52/309.14
8,714,495 B2 * 5/2014 Myers ..... F16B 2/12 248/300
9,260,865 B2 * 2/2016 Rothwell ..... E04C 2/205
(Continued)

*Primary Examiner* — Paola Agudelo
(74) *Attorney, Agent, or Firm* — Kyle R Satterthwaite; Ryan W. Dupuis; Ade & Company, Inc.

(57) ABSTRACT

Corrugated furring strips are used on the outer side of an exterior insulation layer in an exterior wall construction. The corrugated furring strips support a final cladding layer at an offstanding position from the insulation, thereby providing a rainscreen. The corrugated furring strips are fastened to the framework of the wall through the exterior insulation layer. Optional bridging members shaped to conformingly mate with lands and grooves of the corrugated furring straps cooperate therewith to define a support grid with improved load capacity for heavier cladding materials and more fastening location options. The insulation layer is free of any thermal bridges other than the insulation-penetrating fasteners used to support the furring and optional bridges. Thermally insulative washers isolate the furring and optional bridges from the fasteners to further improve the insulating effect of the wall.

20 Claims, 5 Drawing Sheets

(56) References Cited

U.S. PATENT DOCUMENTS

| | | | | |
|---|---|---|---|---|
| 9,422,722 | B2 * | 8/2016 | Iannelli | E04D 13/064 |
| 2011/0185641 | A1 * | 8/2011 | Snell | E04D 13/076<br>52/12 |
| 2012/0174511 | A1 * | 7/2012 | Harding | B66F 9/142<br>52/302.1 |
| 2016/0160515 | A1 * | 6/2016 | Wallance | E04B 1/3483<br>52/79.1 |
| 2017/0198481 | A1 * | 7/2017 | Krause | E04F 13/0803 |

* cited by examiner

FIG. 7A
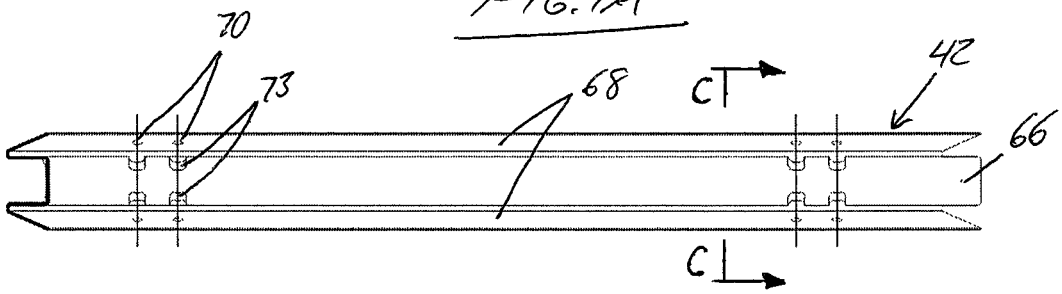
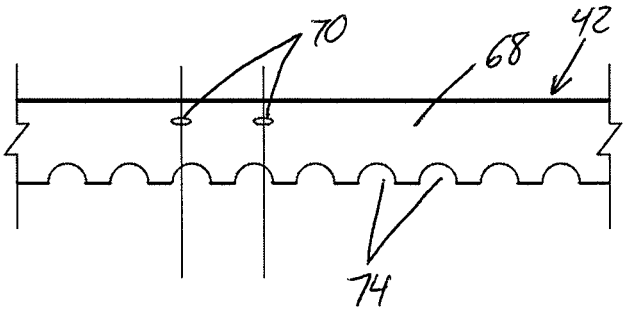
FIG. 7B
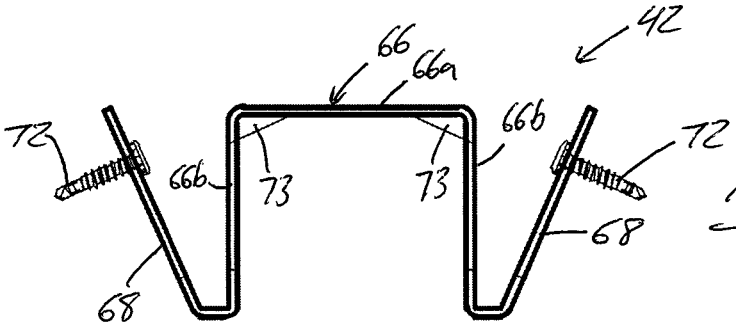
FIG. 7C
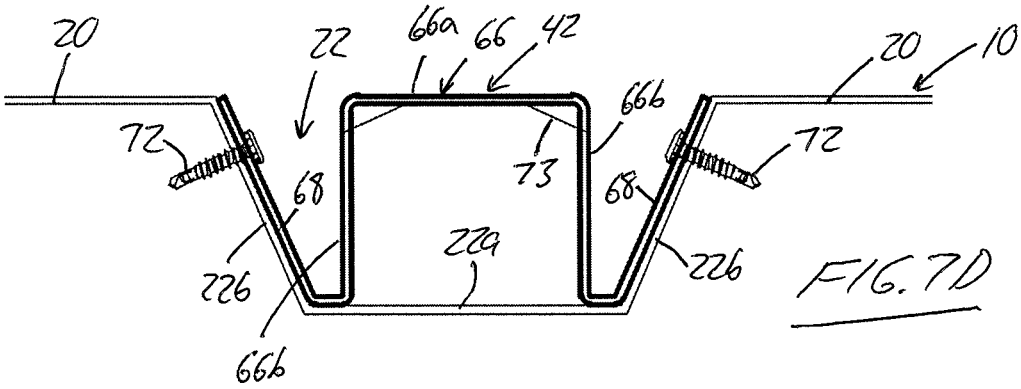
FIG. 7D

CORRUGATED FURRING STRIPS AND USE OF SAME IN UPRIGHT WALL STRUCTURES

CROSS REFERENCE TO RELATED APPLICATIONS

This application claims benefit under 35 U.S.C. 119(a) of Canadian Patent Application No. 2,907,245, filed Oct. 5, 2015, the entirety of which is incorporated herein by reference.

FIELD OF THE INVENTION

The present invention relates generally to building construction, and more particularly to the use of corrugated furring strips that are particularly useful in steel-framed cladded wall construction with a rainscreen, where potential benefits include reduced thermal bridging and improved ease of installation.

BACKGROUND

In commercial grade building construction, it is common to employ a multi-layered wall construction in which vertical steel studs are covered with an external sheathing layer, over which a series of metal Z-channels are installed with rigid insulation panels between them to define an external insulation layer, over which another series of metal channels (e.g. hat-channels) are then installed as furring to support the final exterior cladding layer at a spaced distance from the underlying insulation layer in order to create a rainscreen, whereby the resulting air space between the cladding and the insulation space allows drainage and evaporation to occur. This construction method is material and time intensive, requiring installation of the sheathing, addition of the Z-channels thereto, insertion of the insulation between the Z-channels, subsequent mounting of the hat-channels, and finally installation of the exterior cladding. In addition, each Z-channel creates a thermal bridge across the insulation layer over the full length of the channel, thereby reducing the effectiveness of the insulation layer.

Applicant has developed a new furring product and new resulting steel wall construction that addresses the forgoing shortcomings of the forgoing conventional steel wall construction technique.

SUMMARY OF THE INVENTION

According to a first aspect of the invention, there is provided, in combination, an upright wall structure, an exterior cladding for said upright wall structure, and a furring strip comprising an elongated strip of material that is corrugated with alternating lands and grooves in a longitudinal direction of said elongated strip, wherein the elongated strip is mounted to an exterior side of the upright wall structure in abutment therewith at the grooves of the elongated strip, and an interior side of the exterior cladding is mounted to the elongated strip at the lands thereof on an opposite side of an air space that is maintained between said exterior cladding and said upright wall structure by the elongated strip, whereby the elongated strip situates the exterior cladding across the air space from the upright wall structure to create a rainscreen that enables drainage and evaporation from behind the exterior cladding.

According to a second aspect of the invention, there is provided a finished exterior wall comprising:

a wall structure comprising:

a plurality of framing members;

sheathing supported on the plurality of framing members;

an insulation layer situated on an exterior side of the sheathing opposite to the framing members;

furring strips disposed externally of the insulation layer on an outer side thereof opposite the sheathing; each furring strip being corrugated with alternating lands and grooves in a longitudinal direction of said furring strip, the furring strips being oriented with the lands held outwardly away from the insulation layer and the grooves being recessed toward the insulation layer from said lands, and the furring strips being fastened to the framing members at the grooves in said corrugated furring strips; and exterior cladding placed over, and fastened to, the lands of the corrugated furring strips, whereby the corrugated furring strips space the exterior cladding outwardly away from the insulation layer to create a rainscreen;

wherein the corrugated furring strips are abutted directly against the insulation layer with no intermediate disposed therebetween.

According to a third aspect of the invention, there is provided a method of assembling a finished exterior wall, the method comprising:

on a wall structure having a plurality of framing members, sheathing supported on the plurality of framing members, and an insulation space situated on an exterior side of the sheathing opposite to the framing members:

(a) installing corrugated furring strips externally of the insulation space on an outer side thereof opposite the sheathing with lands of the corrugated furring strips held outwardly away from the insulation space and grooves of the corrugated furring strips recessed toward the insulation space from said lands, including fastening the furring strips to the framing members at the grooves in said corrugated furring strips; and (b) installing exterior cladding over the lands of the corrugated furring strips, whereby the corrugated furring strips space the exterior cladding outwardly away from the insulation space;

wherein step (a) comprises starting at one end of the wall structure, and in a single pass moving toward an opposing second end of the wall structure, inserting insulation material into the insulation space and periodically fastening the corrugated furring strips in place through inserted pieces of said insulation material prior to insertion of subsequent pieces of said insulation material into the insulation space.

According to a fourth aspect of the invention, there is provided a furring strip comprising an elongated strip of material that is corrugated with alternating lands and grooves in a longitudinal direction of said elongated strip, and has at least one longitudinal rib formed in said elongated strip.

According to a fifth aspect of the invention, there is provided a furring strip in combination with an upright wall structure, a plurality of fasteners by which the furring strip is mounted to said upright wall structure, and a plurality of washers respectively installed between the elongated strip and heads of said plurality of fasteners, wherein the furring strip comprises an elongated strip of material that is corrugated with alternating lands and grooves in a longitudinal direction of said elongated strip and the washers are less thermally conductive than the fasteners.

According to a sixth aspect of the invention, there is provided a furring strip in combination with a land-covering bridging member, the furring strip comprising an elongated strip of material that is corrugated with alternating lands and grooves in a longitudinal direction of said elongated strip, and the land-covering bridging member being arranged for mating with the furring strip in a position lying perpendicularly thereto with a cross-sectional profile of the land-covering bridging member conformingly overlying a respective land of the elongated strip and reaching downwardly into adjacent grooves on opposite sides of said respective land.

According to a seventh aspect of the invention, there is provided a furring strip in combination with a groove-occupying bridging member, the furring strip comprising an elongated strip of material that is corrugated with alternating lands and grooves in a longitudinal direction of said elongated strip, and the groove-occupying bridging member being arranged for mating with the furring strip in a position lying perpendicularly thereto with a cross-sectional profile of the groove-occupying bridging member received in a respective groove of the elongated strip.

BRIEF DESCRIPTION OF THE DRAWINGS

One embodiment of the invention will now be described in conjunction with the accompanying drawings in which:

FIG. 7A is an isolated view of another bridging member that spans between the corrugated furring strips of FIGS. 1 and 2 in a position occupying matching grooves of the two furring strips.

FIG. 7B is a side view of the bridging member of FIG. 7A.

FIG. 7C is a cross-sectional view of the bridging member of FIG. 7A, as viewed along line C-C thereof, in combination with fasteners for attaching the bridging member to the corrugated furring strips.

FIG. 7D is a cross-sectional view similar to FIG. 7C, but showing the bridging member thereof in cooperative assembly with one of the corrugated furring strips.

In the drawings like characters of reference indicate corresponding parts in the different figures.

DETAILED DESCRIPTION

Figure 3B:
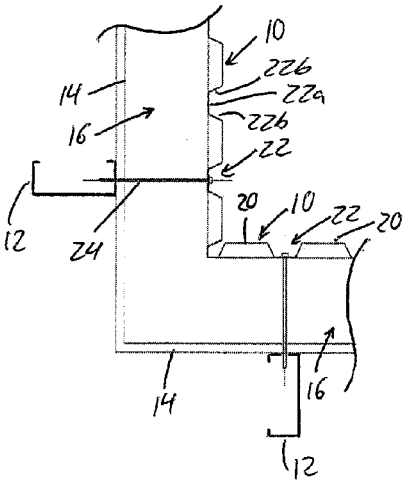
FIG. 3B is a plan view of an inside corner of the steel construction exterior wall of FIG. 1.
Figure 3A:
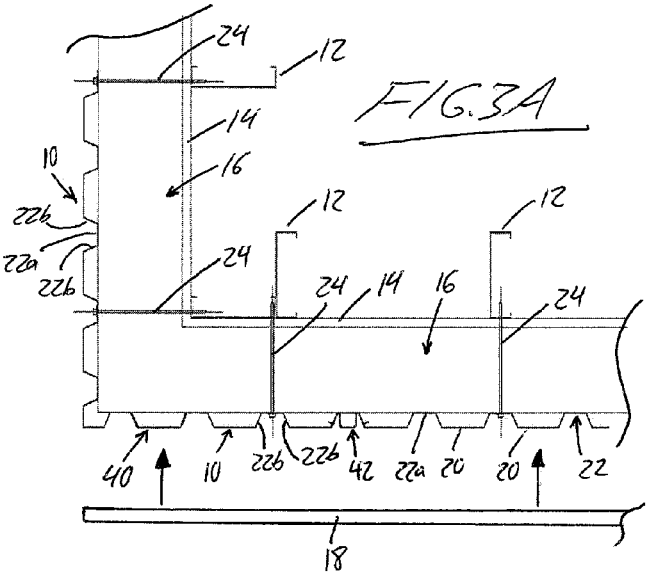
FIG. 3A is a plan view of an outside corner of the steel construction exterior wall of FIG. 1.

FIGS. 3A and 3B illustrate a construction of a steel framed externally insulated exterior wall using corrugated metal furring strips 10 to support the final exterior cladding layer 18 of the finished wall. The wall features a series of vertically upright steel studs 12 horizontally spaced apart from one another at regular intervals to form a structural framework of the wall, and a layer of exterior sheathing 14 fastened to the studs 12 at outwardly facing edges thereof. A layer of insulation 16 resides opposite the studs on the external side of the sheathing 14, and may feature semi-rigid mineral wool, rigid insulation, insulation panels, structural insulated panels (SIP), or other thermal insulation. Each furring strip 10 is mounted opposite the sheathing 14 on the outer side of the insulation layer 16, and is fastened to the studs 12 through the insulation layer 16 and underlying sheathing 14. The finished wall is completed by the installation of cladding 18 over the furring strips 10, which act to space the cladding 18 outwardly away from the underlying insulation layer 16 in order to create a rainscreen having an open airspace behind the cladding 18 for drainage and evaporation purposes.

Each corrugated furring strip 10 has a longitudinal direction in which its corrugated shape alternates between lands 20 and grooves 22. In longitudinal planes parallel to the longitudinal direction of the furring strip 10, the lands 20 are flat or linear in shape, and the grooves are trapezoidal. A floor or bottom 22*a* of each groove 22 lies coplanar with the floors or bottoms of the other grooves, and parallel to the lands 20, which are likewise coplanar with one another. The floor or bottom 22*a* of each groove is obliquely joined to the two neighbouring lands 20 by angled side walls 22*b* of the groove's trapezoidal shape. The furring strips 10 are installed in an orientation placing the floor or bottom 22*a* of each groove against the outer side of the insulation layer 16 (i.e. the side thereof facing outwardly away from the interior space of the building). The lands 20 are thus held outwardly away from the insulation layer 16 by the angled side walls 22*b* of the grooves, while the bottom 22*a* of each groove is recessed toward the insulation layer from the lands 20. To support the furring strips 10, threaded fasteners 24 are driven through the furring strips 10 at select grooves 22 that align with the studs 12 of the wall's structural framework.

Figure 1:
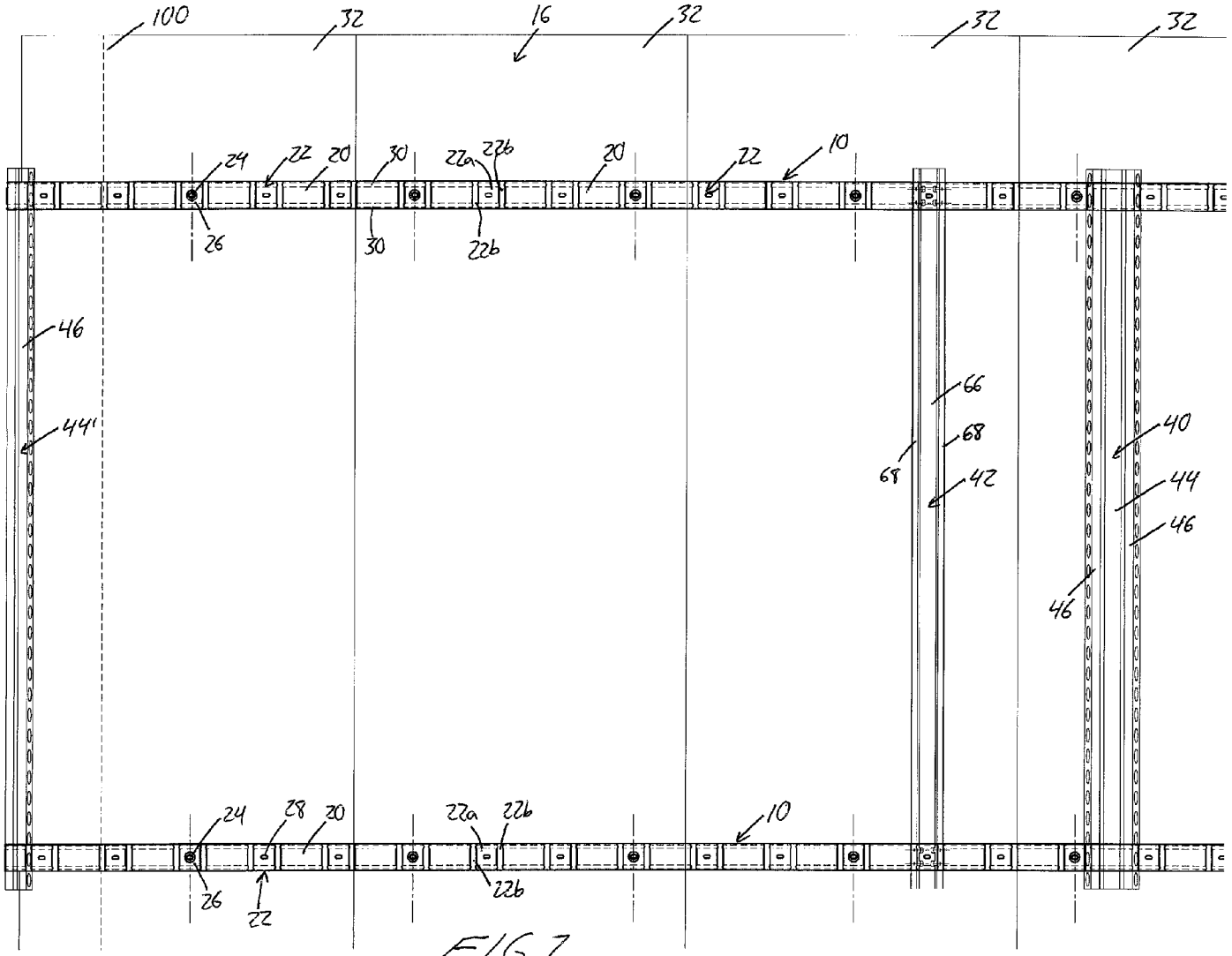
FIG. 1 is an elevational view illustrating horizontal installation of corrugated metal furring strips to exterior sheathing during erection of a steel construction exterior wall.

FIGS. 1 and 3 illustrate horizontal installation of the furring strips, in which case the longitudinal direction of each corrugated furring strips spans horizontally across multiple studs 12 and is accordingly fastened to more than one such stud. While the bottoms of the fastened grooves are held against the insulation by the fasteners, drainage and airflow vertically across the horizontal furring strip is allowed by the open space between the insulation and the lands 20 on both sides of each fastened groove.

Figure 2:
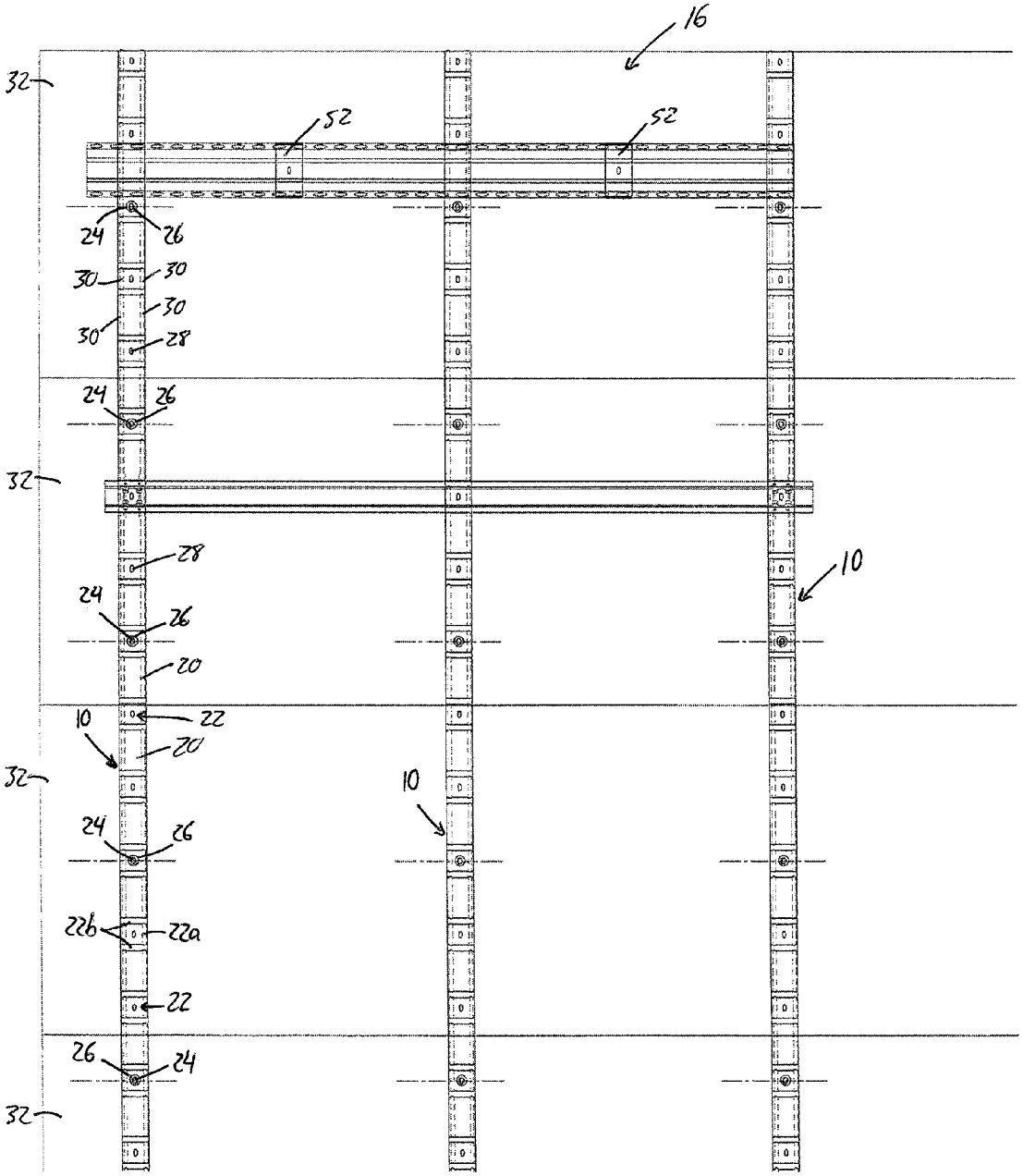
FIG. 2 is an elevational view illustrating vertical installation of corrugated metal furring strips to exterior sheathing during erection of a steel construction exterior wall.
Figure 4B:
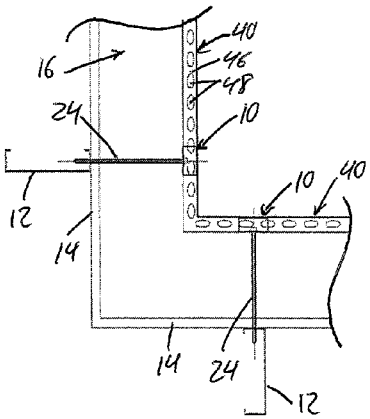
FIG. 4B is a plan view of an insider corner of the steel construction exterior wall of FIG. 2.
Figure 4A:
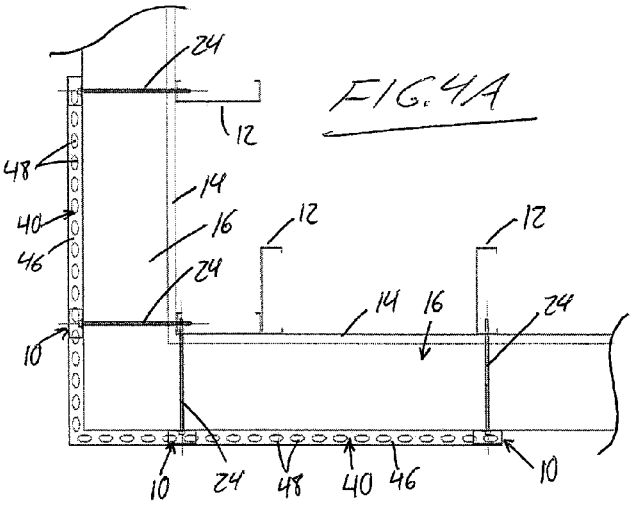
FIG. 4A is a plan view of an outside corner of the steel construction exterior wall of FIG. 2.

FIGS. 2 and 4A-B illustrate vertical installation of the furring strips, in which case the longitudinal direction of each corrugated furring strip spans vertically along a singular studs 12 at a position aligned therewith across the insulation and sheathing layers, and so each furring strip is fastened only to a respective single stud at vertically spaced positions therealong. If the framework of the wall features bridges or blocks spanning horizontally between adjacent studs, furring strips may additionally be fastened to such components of the framework at grooves of the furring strips that align therewith. The open space between the insulation layer and each land enables airflow across the vertical furring strip to communicate the airspaces or cavities on opposite sides of each furring strip with one another.

To minimize thermal bridging between the interior and exterior of the finished wall, each threaded fastener 24 is fitted with a washer (26) of thermally insulative material that has lower thermal conductivity than the threaded fastener 24 and the corrugated furring strip, whereby the head of the fastener 24 is separated from the floor or bottom 22*a* of the groove 22 by the washer 26 in order to thermally isolate the furring strip 10 from the fastener 24. The fasteners 24 are the only members traversing the insulation layer 16, thus reducing the amount of thermal bridging compared to conventional steel wall construction techniques in which Z-channels traverse the external insulation layer. Together with the insulative washers 26 that reduce conductive heat transfer from the fasteners 24 to the corrugated metal furring strips 10, the insulation layer of the finished wall structure is particularly effective.

As shown in FIGS. 1 and 2, the floor or bottom 22*a* of each groove 22 in each furring strip 10 features a predefined fastener opening 28 having an oblong shape that is elongated in the longitudinal direction of the furring strip 10. The width of the oblong shape (measured perpendicularly of the longitudinal direction along the minor axis of the oblong shape) slightly exceeds to the diameter of the threaded fasteners 24 to accommodate passage of the respective fastener 24 through the fastener opening without requiring drilling of the metal furring strip during installation. The length dimension of the fattener opening 28 measured in the longitudinal direction on the major axis of the oblong shape exceeds the width of the fastener opening in order to accommodate a degree of longitudinal adjustment of the fastener position along the floor or bottom of the groove to enable proper alignment of the fastener with a respective stud 12 of the wall framework in the case of horizontal installation of the furring strip 10.

Each furring strip 10 features a pair of longitudinal ribs 30 at each land 20, and a matching pair of longitudinal ribs at the floor or bottom 22*a* of each groove 22. The two ribs of each pair lie parallel to the central longitudinal axis of the furring strip 10 at symmetric positions on opposite sides thereof, and so each rib thus resides adjacent a respective side edge of the furring strip. The longitudinal ribs 30 are of radiused curvature in cross-sectional planes lying normal to the longitudinal direction, and serve to reinforce the strength of the corrugated strip. During manufacture, each strip may be pressed into its corrugated form from an initially flat strip-shaped blank, which for example may have been punched or cut from a larger metal sheet, and then punched in one or more operations to create the oblong fastener openings 28 and the longitudinal reinforcement ribs 30. While the drawings show separation of the ribs on the floor of each groove from the ribs on the adjacent lands, i.e. a lack of illustrated connecting ribs on the side walls of the groove that join up with the ribs on the lands and the groove floors, the furring strip may alternatively feature full-length ribs continuously spanning the entirety of the strip from one end to the other. In such instance, the continuous full-length ribs may be pressed into the sheet or blank prior to forming thereof into the final corrugated shape.

FIG. 1 illustrates horizontal installation of the corrugated furring strips 10 during erection of a steel-framed, externally insulated wall. Here, the insulation layer 16 is formed by elongated rectangular insulation panels 32 that are mated together side-by-side in upright orientations over the underlying stud framework of the wall. Each furring strip 10 spans across a plurality of the insulation panels 32 and is fastened to the regularly spaced framework studs 12 through the insulation panels. To accomplish this, the insulation panels and furring strips 10 may be installed together during a single pass along the sheathed wall framework from one end to the other. Starting at one end, a first insulating panel, or first set of two or more insulating panels, are placed up over the sheathing, and then one of the furring strips is held up at a selected height and a first threaded fastener 24 is driven into a stud at this starting end of the sheathed wall structure through the underlying first insulation panel. At any subsequent studs likewise already covered by the initially placed insulation panel(s), a respective fastener 24 (accompanied by a thermally insulative washer 26) is driven into the stud 12 through insulation layer 16 at the respective groove 22 of the corrugated furring strip 10. This placement and fastening of a corrugated furring strip is repeated at another height on the same wall at a positioned spaced from and parallel to the first strip, for example to accomplish the illustrated two-strip furring configuration of FIG. 1. The next insulation panel (or next group of panels) is then inserted behind the furring strips and shifted back toward the first end of the wall framework in order to mate with the last inserted insulation panel at the upright side edge thereof, at which point the furring strips can be fastened into the next stud 12 through this latest insulation panel. These steps are repeated until the installer reaches the second end of the wall framework, where this same process can be repeated along the next side of the building until the full perimeter of the building has been furred.

FIG. 2 illustrates vertical installation of corrugated furring strips 10. Here, the insulation layer 16 is again formed by elongated rectangular insulation panels 32, but this time mated together in horizontal orientations stacked one atop the other over the underlying stud framework of the wall. Each furring strip 10 spans vertically across a plurality of the insulation panels 32 and is fastened to a respective singular stud 12 of the wall framework. Again, the insulation panels and furring strips 10 may be installed together during a single pass along the sheathed wall framework from one end to the other. Starting at one end, a first set of two or more insulating panels are stacked atop one another over the sheathing, and then one of the furring strips is aligned over the first stud at this first end of the sheathed wall framework and fastened into place using a series of threaded fasteners 24 driven into the first stud through the insulation panels at grooves of this first furring strip, again using the insulative washers 26. At any subsequent studs likewise already covered by the first stack of insulation panel(s), an additional respective furring strip is likewise fastened in place in alignment with the respective wall stud 12. The next set of insulation panels are then stacked up and mated side-to-side with the previous stack, with corresponding furring strips then respectively fastened to the studs residing behind this latest stack of insulation panels. These steps are repeated until the installer reaches the second end of the wall framework, where this same process can be repeated along the next side of the building until the full perimeter of the building has been furred.

In the forgoing installation processes, the insulation and furring strip are installed in conjunction and do not require two separate steps, substantial additional fasteners, adhesives or supplementary layers of additional metal framing or furring, as is traditionally required. Cladding is subsequently installed over the lands of the furring strips, whereupon the corrugated strips provide for a complete separation of cladding and substrate, and a full thermally-broken rain screen system is achieved.

As different types of cladding will vary in weight and required structural support, the fastening of the furring strips to the studs may alone be sufficient for some types of cladding, but not others. Accordingly, bridging members 40, 42 may be used to perpendicularly interconnect two or more corrugated furring strips 10 as shown in FIGS. 1 and 2 to form a more rigid support grid for carrying the final cladding layer of the finished wall assembly. Use of the bridging members can also serve other purposes, for example to provide for additional fastening locations at areas other than the furring strips themselves, for example at panel joints or at locations of wall penetrations where mechanical, electrical or other protuberances are present or required.

Figures 5A, 5B, 5C, 6A, 6B, 6C:
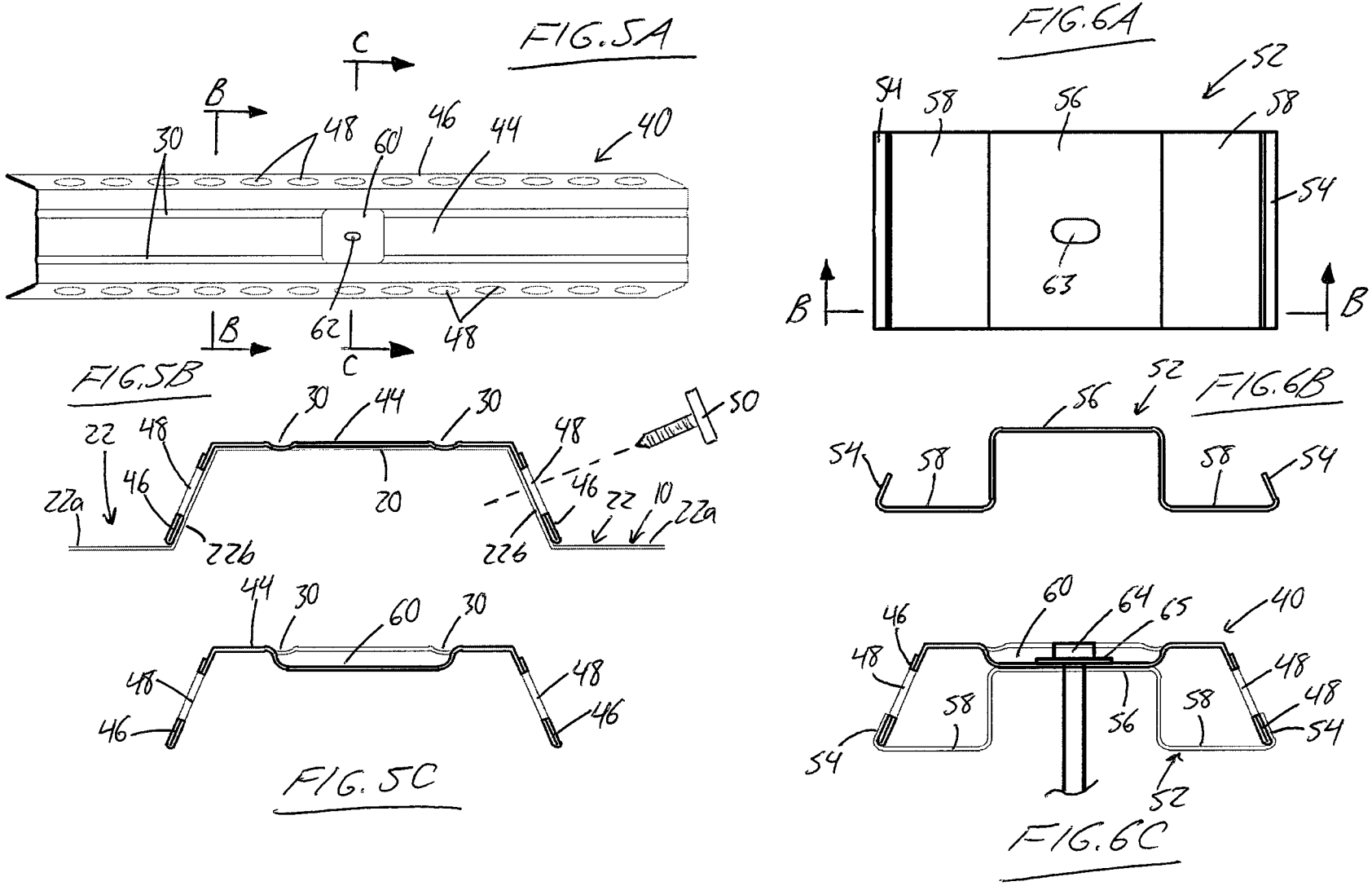
FIG. 5A is an isolated view of a bridging member that spans between the corrugated furring strips of FIGS. 1 and 2 in a position overlying matching lands of the two corrugated furring strips.
FIG. 5B is a cross-sectional view of the bridging member of FIG. 5A as taken along line B-B thereof.
FIG. 5C is a cross-sectional view of the bridging member of FIG. 5A as taken along line C-C thereof.
FIG. 6A is an isolated view of a support brace for providing auxiliary support to the bridging member of FIG. 5A at an intermediate location between the corrugated furring strips.
FIG. 6B is a cross-sectional view of the support brace of FIG. 6A as viewed along line B-B thereof.
FIG. 6C is a cross-sectional view illustrating the bridging member and support brace of FIGS. 5C and 6B in cooperative assembly with one another.

FIG. 5 shows a first type of bridging member 40 configured to mate with the corrugated furring strips in positions overlying the lands 20 thereof, and is therefore referred to herein as a land-covering bridging member 40. The land-covering bridging member 40 is an elongated metal channel of trapezoidal cross-sectional profile, which has a central span 44 and two side walls 46 extending obliquely downward from opposing sides of the central span. As best shown in FIGS. 5B and 5C, the thickness of each side wall 46 may be doubled up by bending of the channel back over itself at the lower end of the side wall 46 to increase the strength of the channel profile. The angle of divergence between the side walls 46 of the land-covering bridging member 40 matches the angle of divergence between the angled sides 22*b* of the trapezoidal grooves 22 in the furring strips 10, and the width of the central span 44 between the two side walls 46 of the land-covering bridging member 40 matches or slightly exceeds the width of each land 20 of the corrugated furring strips 10. As a result, each land-covering bridging member 40 is matable with each furring strip 10 in a position embracing over a respective one of the lands and reaching downwardly into the two adjacent grooves 22. In width, the side walls 46 of the land-covering bridging member 40 are equal to or slightly shorter than the side walls of the grooves 22 so that the land-covering bridging member 40 conforms to the underlying furring strip 10, with the central span 44 of the land-covering bridging member 40 sitting flush atop the respective land 20 of the furring strip and the side walls 46 of the land-covering bridging member 40 likewise sitting generally flush atop the adjacent sides 22*b* of the two neighbouring grooves 22.

Placement of the land-covering bridging member 40 over a set of matching lands on the installed furring strips 10 places the land-covering bridging member 40 in a position spanning perpendicularly across the furring strips 10. Each side wall 46 of the land-covering bridging member 40 features a series of vent holes 48 therein that are uniformly spaced apart in relatively close proximity over the full length of the land-covering bridging member 40. Where these vented side walls of the land-covering bridging member 40 overlie the corrugated furring strips, the land-covering bridging member 40 can be attached to each of the furring strips by driving a respective self-tapping screw fastener 50 through the vent hole 48 in one or both of the bridging member's side walls into the angled side wall 22*b* of the respective groove 22 of the furring strip 10. Accordingly, the head of the screw fastener 50 resides within the groove 22, and therefore does not project beyond the plane of the lands 20 and interfere with flush mounting of the cladding 18 against the gridwork of furring strips and bridging members. Other means of securing the land-covering bridging member 40 to the furring strips may be employed, for example using mating features built-into these components to provide a snap-lock fit or other self-locking attachment therebetween, for example similar that mentioned below for the groove-occupying bridging member.

While the described flush-mounted conformance of the land-covering bridging member 40 to the furring strips means that the land-covering bridging member 40 will be spaced from the underlying insulation layer 16 by at least the thickness of the furring strips 10 at the bottom of floor of the grooves, thereby allowing airflow across land-covering bridging member 40 from one side thereof to the other in the finished wall structure, the vent holes 48 in the side walls 46 improve this allowable airflow, while also allowing drainage. For strengthening purposes, the central span 44 of the land-covering bridging member 40 features a pair of symmetrically disposed longitudinal ribs 30 on opposite sides of the central longitudinal axis of the bridging member 40, for example, just like those of the corrugated furring strips 10.

The attachment of each land-covering bridging member 40 to the furring strips reinforces the mounting of the furring strips to the studs 12 in order to provide a substantially rigid support grid on which to the carry the cladding. Further reinforcement of the support grid can be provided by installation of the support brace 52 shown in FIG. 6, which cooperates with the bridging member 40 at an intermediate position therealong between the furring strips 10. The support brace 52 is similar to a short length of hat-shaped channel with short upturned retention tabs 54 on opposite sides of the channel-profile. The support brace 52 thus has a three-sided central rectangular channel 56 that opens downwardly, a pair of legs 58 that extend laterally outward from opposite sides of the open side of the channel 56, and a respective upturned retention tab 54 at the distal end of each leg 58. The coplanar legs 58 lying perpendicular the side walls of the central channel 56 define a base plane of the support brace 52. In the installed position of the brace 52, this base resides against a support surface defined by the outer side of the insulation layer 16. The three-sided central channel 56 of the support brace 52 stands off from the base plane to one side thereof in order to abut against an underside of the central span 44 of the land-covering bridging member 40, and thereby provide support to same.

The central span 44 of the land-covering bridging member 40 has recessed areas 60 therein at spaced apart positions along the member's longitudinal direction. These recessed areas 60 reside between the furring strips 10 in the final assembled state of the support grid. Each support brace 52 is placed beneath a respective one of these recessed areas 60, and the height of the support brace 52 measured from the underside of the base legs 58 to the topside of the central rectangular channel 56 is generally equal to the distance from the plane of the outside surface of the insulation layer to the underside of the recessed area 60 of the land-covering bridging member 40. Accordingly, the topside of the support brace's central channel 56 abuts against the recessed area 60 of the land-covering bridging member 40. Each recessed area 60 features a predefined fastener hole 62 at a central location of the recess to enable driving of threaded fastener 64 through a corresponding aperture 63 in the central channel 56 of the support brace 52 and onward through the insulation layer 16 to a suitable anchor point in the wall framework (e.g. in a stud, or bridge/block thereof). The fastener 64, shown in FIG. 6C, thereby couples the support brace 52 and overlying bridging member 40 together, and secures the same to the rigid wall framework. A thermally insulative washer 65 is again used with this insulationpiercing fastener 64 to minimize thermal bridging by thermally isolating the fastener 64 from the underlying bridging member 40.

The upturned tabs 54 at opposing sides of the support brace 52 angle inwardly toward one another at an angle of convergence generally matching the angle at which the two side walls 46 of the land-covering bridging member 40 converge toward the central span 44 thereof, and the width of the support brace's base between the two tabs 54 generally matches the width of the open side of the land-covering bridging member 40, as measured across the distal ends of the angled side walls 46 thereof. As shown in FIG. 6C, the land-covering bridging member 40 is placed over the support brace 52 into a position in which the recessed area 60 of the bridge member's central span 44 abuts flush against the topside of the support brace's central channel 56, and the tabs 54 of the support brace clip externally over the bottom ends of the side walls 46 of the land-covering bridging member 40 below the vent holes 48 therein. Accordingly, the support brace engages to the underside of the land-covering bridging member in a snap-fit therewith that maintains the support brace in proper alignment beneath the recessed area 60 of the land-covering bridging member until the fastener 64 is driven through the aligned fastener hole 62 and aperture 63 in the two snapped-together components 40, 52.

FIG. 7 shows the other type of bridging member 42 which is also used to perpendicularly join two or more corrugated furring strips 10 together, as shown in FIGS. 1 and 2, but does so at matching grooves 22 of the furring strips 10, rather than at matching lands 20 thereof. This second bridging member 42, therefore referred to as a groove-occupying bridging member 42, is an elongated metal channel having a somewhat W-shaped cross-sectional profile. The cross-sectional shape features a downwardly opening three-sided rectangular channel 66 at its center, much like the support brace 52 of FIG. 6, but instead of two flat legs extending perpendicularly outward from the sides of the central three-sided rectangular channel 66, the groove-occupying bridging member 42 features two angled wings 68 extending obliquely upwardly and outwardly from the open lower side of the central three-sided rectangular channel 66 at acute angles from the two opposing side walls thereof. The angle at which the wings 68 diverge from one another is generally equal to the angle at which the two side walls 22*b* of each groove 22 in the corrugated furring strips diverge from one another, and the width of the central three-sided rectangular channel 66 measured between the two angled wings 68 is generally equal to the floor-width of each such groove 22.

Accordingly, as shown in FIG. 7D, insertion of the groove-occupying bridging member 42 into one of the grooves 22 with the central three-sided rectangular channel 66 opening downwardly acts to seat the groove-occupying bridging member 42 within the groove in a conforming manner, in which the two angled wings 68 of the groove-occupying bridging member 42 reside flush against the two side walls 22*b* of the respective groove 22. Each angled wing 68 features a respective set of apertures 70 therein near each end of the groove-occupying bridging member 42. The distance between the two sets of apertures 70 in each angled wing 68 matches the distance by which two corrugated furring strips 10 are spaced apart from one another in the assembled support grid. Accordingly, a respective self-tapping fastener 72 can be driven through one or more of the apertures 70 in each set in order to fasten the groove-occupying bridging member 42 to the side walls 22*b* of the grooves 22 in the furring strips. In addition to anchoring of each groove-occupying bridging member 42 to the respective corrugated furring strips with threaded fasteners, the bridging member 44 and furring strips may be arranged to self-couple to one another by way of a clip-like connection, for example through use of small tabs pressed into the bridging during manufacture, which can then be snapped into receiving openings on the furring members. This clipped snap fit connection would temporarily secure the two components together while the fasteners 72 are installed to form a more robust attachment between them.

Fastening of both types of bridging members 40, 42 to the side walls of the grooves places all the fastener heads inside the grooves 22, where they won't project beyond the plane of the lands 20 of the furring strip in the finished support grid. This prevents the fasteners from interfering with flush mounting of the cladding layer 18 atop the support grid in the final step of the wall construction. To enable driving of the self-tapping fasteners 72 perpendicularly through the angled wings 68 of the groove-occupying bridging member 42 and underlying angled side of the furring strip groove 22 without interference from the central rectangular channel 66 of the bridging member 42, a respective fastener depression 73 is provided at the topside of the channel 66 at a position aligned with each fastener hole 70 in the wing 68. The depression 73 slopes downwardly and outwardly away from the center of the rectangular channel's topside 66*a* to the respective side wall 66*b* of the rectangular channel, thus defining a recessed area at the corner of the three-sided central channel 66. The depression or recess is sloped at an angle of ninety degrees to the plane of the respective wing 68. Accordingly, each depression 73 defines a sloped pathway along which the respective fastener 72 can be driven through the wing 68 of the groove-occupying bridging member 42 at a proper ninety degree angle thereto. Each predefined fastener aperture 70 and its respective fastener depression 73 thus collectively define a fastening guide for driving the respective fastener 72 into the side of the furring strip groove 22 at the appropriate angle.

With reference to FIG. 7B, a series of notches or cut-outs 74 are provided at regularly spaced intervals over the length of the groove-occupying bridging member 42 at the bent corner between each angled wing 68 and the respective side wall of the central three-sided rectangular channel 66. These act similar to the vent holes 48 of the land-covering bridging members 40 to improve the allowed airflow across the groove-occupying bridging member 42 within the assembled support grid. These notches or cut-outs 74 may be formed by punching holes into a flat metal blank along the intended bend lines on which the blank is subsequently folded during a pressing operation to create the cross-sectional profile of the groove-occupying bridging member 42. This way, a single linear array of holes produces openings in both the angled wing 68 and the adjacent side wall of the central three-sided rectangular channel 66.

A height of the central channel 66 of the groove-occupying bridging member 42 is equal to a height of depth of each groove 22 in the corrugated furring strips 10 such that the topside of the channel 66 resides flush with the coplanar lands 20 of the corrugated furring strip 10 in the installed position of the groove-occupying bridging member 42, in which the open bottom side of the central channel 66 is seated against the bottom or floor 22*a* of the respective groove 22. This way, placement of a cladding layer 18 in abutment against the lands 20 of the furring strips 10 will likewise place the cladding layer 18 in abutment against the central channel 66 of the groove-occupying bridging member 42 for robust support of the cladding layer.

When reinforcement of the furring strips by bridging members is required, for example to ensure adequate support for the cladding layer that is to be installed over the corrugated furring strips, either the land-covering bridging members or the groove-occupying bridging members 42, or a combination thereof, may be used to cooperatively form a more rigid support grid with the corrugated furring strips. FIGS. 1 and 2 illustrate use of both types of bridging members to span between parallel corrugated furring strips. FIG. 2 additionally shows the use of support braces 52 to further reinforce the land-covering bridging members 40 at intermediate points thereon between each parallel pair of corrugated furring strips 10. Once the furring strips, and any optional bridging members, are installed over the insulation layer 16, the cladding 18 can be placed up over the furring strips or support grid, and fastened thereto through the lands 20 of the corrugated furring strips 10. Some of these lands 20 may be overlaid with the optional land-covering bridging members 40, in which case a threaded fastener driven through the cladding 18 and into the corrugated furring strips is driven through the overlying bridging member 40 in the process, thereby further strengthening the fastened connection between the bridging member and the furring strip, and giving the cladding fastener more material to bite into to better support the cladding layer 18.

In one example, the furring strips may be pre-formed light gauge, galvanized metal strip, 50 mm wide, 25 mm in height, and of any length limited only by ease of use and fabrication. The fasteners 24 by which the furring strips are mounted to the wall framework through the simulation may, for example, be full depth screws, c/w, 30 mm diameter phenolic washers to provide the described thermal break. Use of stainless or non-conductive fasteners will significantly reduce or eliminate thermal bridging at the exterior wall.

The land-covering bridging members 40 may be pre-formed 18-gauge galvanized metal strip, reinforced with rolled edges and the aforementioned radiused channels or ribs along its length. The recessed areas or localized depressions 60 may be spaced apart from one another at 406 mm or 610 mm intervals to match typical wall framing intervals at which the studs are spaced apart from one another, and the furring strips are preferably spaced apart by the same interval during installation so that each support braces reside centrally between two furring strips. The braces allow optional standalone installation of the land-covering bridging members in matching orientation to wall framing members (e.g. studs) behind the insulation layer. The land-covering bridging members may also be used to provide closures at corners of the building where different walls meet, for example by folding a land-covering bridging member around an outside corner of the building. This is shown in FIG. 1, where broken line 100 denotes the interior side of the insulation layer of an "out-of-plane wall" that lies perpendicularly from the "in-plane" wall (i.e. the wall that features the solid-line insulation layer 16 residing "in the plane" of the drawing sheet). A folded land-covering bridging member 44' overlies a half-land on each of the two illustrated corrugated furring strips 10 on the "in-plane" side of the building, and folds around a corner of the building to the "out-of-plane" side of the building, where the remainder of the folded bridging member 44' overlies a half-land on each of another two corrugated furring strips. The half lands of the furring strips on the two sides of the building meet up with one another at the corner, and each side wall 46 of the folded bridging member 44' resides on a side wall 22*b* of the furring strip groove 22 that is nearest the building corner on each of the two furring strips on a respective one of the two adjacent sides of the building.

The groove-occupying bridging members may be pre-formed 18-gauge galvanized metal strip, with folds arranged to reinforce its cross-sectional profile, and may be configured to clip into the grooves of the corrugated furring members, and optionally further fastened with self-tapping fasteners. Even if the cut-outs or notches 74 were omitted from the groove-occupying bridging member, a drainage space is provided therebeneath by the thickness of the main furring strips in order to provide a complete rain screen regardless of the horizontal or vertical installation direction. Both types of bridging members are used for bridging or blocking of the furring strips to create an overall support grid, which provides additional strength, backing and/or blocking for variations in cladding orientation and sizes.

The support brace 52 may be pre-formed 18-gauge galvanized metal piece, 50 mm wide, with a folded profile to clip into the land-covering bridging members. The brace's profile allows for solid bearing of the base of the brace against the insulation/sheathing, and provides support directly under the top of the bridging member's central channel for fastening into the wall framing, similar to fastening of conventional strapping installations.

Although not detailed in the drawings, stretcher clamps may be provided, for example in the form of pre-formed light-gauge galvanized metal strip, 38 mm wide and 203 mm in length, and reinforced with radiused ribs or channels along its length. Three fastener locations are punched to allow for use in localized reinforcement of the corrugated metal furring strips 10. These can be used in vertical orientations to match wall framing, or in horizontal applications, but only where blocking has been installed in wall framing to suit. Although not shown, adjustable clips may be provided for hidden fastener cladding installation. Such clips may be supported off of the lands of the primary furring strips, and off of one or both types of bridging members 40, 42 in the horizontal furring installation format.

It will be appreciated that the specific material and dimensional details presented above are for exemplary purposes only, and may be varied without effect on the functionality of the present invention.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. In combination, an upright wall structure, an exterior cladding for said upright wall structure, and a furring strip comprising an elongated strip of material that is corrugated with alternating lands and grooves in a longitudinal direction of said elongated strip, wherein the elongated strip is mounted to an exterior side of the upright wall structure in abutment therewith at the grooves of the elongated strip, and an interior side of the exterior cladding is mounted to the elongated strip at the lands thereof on an opposite side of an air space that is maintained between said exterior cladding and said upright wall structure by the elongated strip, whereby the elongated strip situates the exterior cladding across the air space from the upright wall structure to create a rainscreen that enables drainage and evaporation from behind the exterior cladding.

2. The combination of claim 1 wherein each groove of the furring strip has at least one longitudinal rib formed therein.

3. The combination of claim 2 wherein each groove of the furring strip comprises two longitudinal ribs disposed on opposing sides of a lateral center of the groove.

4. The combination of claim 2 wherein each longitudinal rib has a curved profile in transverse cross-sectional planes lying normal to the longitudinal direction of the elongated strip.

5. The combination of claim 1 wherein each land of the furring strip has at least one longitudinal rib formed therein.

6. The combination of claim 5 wherein each land of the furring strip comprises two longitudinal ribs disposed on opposing sides of a lateral center of the land.

7. The combination of claim 1 wherein each groove of the furring strip has a trapezoidal profile in longitudinal cross-sectional planes lying parallel to the longitudinal direction of the elongated strip.

8. The combination of claim 7 wherein each land of the furring strip is flat in the longitudinal cross-sectional planes.

9. The combination of claim 1 further comprising a plurality of fasteners by which the furring strip is mounted to said upright wall structure, and a plurality of washers respectively installed between the elongated strip and heads of said plurality of fasteners, wherein the washers are less thermally conductive than the fasteners.

10. The combination of claim 9 wherein the furring strip is abutted against an insulation layer of said upright wall structure which resides externally of a framework of the upright wall structure to which the elongated strip is anchored by the fasteners.

11. The combination of claim 1 further comprising a land-covering bridging member mated with and perpendicular to the furring strip with a cross-sectional profile of the land-covering bridging member conformingly overlying a respective land of the elongated strip and reaching downwardly into adjacent grooves on opposite sides of said respective land.

12. The combination of claim 11 wherein the cross-sectional profile of the land-covering bridging member includes a central span overlying the respective land of the elongated strip and side walls angling downward from the central span on opposite sides thereof to reach into the adjacent grooves of the elongated strip.

13. The combination of claim 12 wherein said side walls of the land-covering bridging member have vent holes therein to allow airflow or drainage across the land-covering bridging member.

14. The combination of claim 1 further comprising a groove-occupying bridging member mated with and perpendicular to the furring strip with a cross-sectional profile of the groove-occupying bridging member received in a respective groove of the elongated strip.

15. The combination of claim 14 wherein the groove-occupying bridging member comprises a channel that opens downwardly toward a floor of the respective groove of the elongated strip and is equal in height to said respective groove in order to place a topside of the channel flush with the lands of the elongated strip with an open side of the channel seated against the floor of the groove.

16. The combination of claim 15 wherein the groove-occupying bridging member comprises wings extending upward from a bottom of the channel at opposite sides thereof in abutment against opposing sides of the groove in the elongated strip.

17. The combination of claim 1 wherein the wall structure comprises a plurality of framing members, sheathing supported on the plurality of framing members; and insulation situated on an exterior side of the sheathing opposite to the framing members, and wherein the furring strips are disposed externally of the insulation on an outer side thereof opposite the sheathing and are fastened to the framing members at the grooves in said furring strips.

18. The combination of claim 17 wherein the furring strips are abutted directly against the insulation layer with no intermediate disposed therebetween.

19. A finished exterior wall comprising:

a wall structure comprising:

a plurality of framing members;

sheathing supported on the plurality of framing members;

an insulation layer situated on an exterior side of the sheathing opposite to the framing members;

furring strips disposed externally of the insulation layer on an outer side thereof opposite the sheathing; each furring strip being corrugated with alternating lands and grooves in a longitudinal direction of said furring strip, the furring strips being oriented with the lands held outwardly away from the insulation layer and the grooves being recessed toward the insulation layer from said lands, and the furring strips being fastened to the framing members at the grooves in said corrugated furring strips; and exterior cladding placed over, and fastened to, the lands of the corrugated furring strips, whereby the corrugated furring strips space the exterior cladding outwardly away from the insulation layer to create a rainscreen;

wherein the corrugated furring strips are abutted directly against the insulation layer with no intermediate disposed therebetween.

20. A method of assembling a finished exterior wall, the method comprising:

on a wall structure having a plurality of framing members, sheathing supported on the plurality of framing members, and an insulation space situated on an exterior side of the sheathing opposite to the framing members:

(a) installing corrugated furring strips externally of the insulation space on an outer side thereof opposite the sheathing with lands of the corrugated furring strips held outwardly away from the insulation space and grooves of the corrugated furring strips recessed toward the insulation space from said lands, including fastening the furring strips to the framing members at the grooves in said corrugated furring strips; and (b) installing exterior cladding over the lands of the corrugated furring strips, whereby the corrugated furring strips space the exterior cladding outwardly away from the insulation space;

wherein step (a) comprises starting at one end of the wall structure, and in a single pass moving toward an opposing second end of the wall structure, inserting insulation material into the insulation space and periodically fastening the corrugated furring strips in place through inserted pieces of said insulation material prior to insertion of subsequent pieces of said insulation material into the insulation space.

* * * * *